United States Patent [19]

Newberry et al.

[11] 3,976,259

[45] Aug. 24, 1976

[54] WINDING WIRE AND OTHER FLEXIBLE MATERIAL

[75] Inventors: John Newberry, Warren Point; Allan George Albert Edward Ettie, Newry, both of Northern Ireland

[73] Assignee: BICC Limited, London, England

[22] Filed: Feb. 28, 1974

[21] Appl. No.: 446,773

[30] Foreign Application Priority Data

Mar. 1, 1973 United Kingdom ..... 10033/73

[52] U.S. Cl. ..... 242/78; 242/25 R; 242/47.01

[51] Int. Cl.[2] ..... B65H 51/20

[58] Field of Search ..... 242/47.01, 47.12, 128, 242/78.1, 78, 47.02, 47.11, 47.13, 25 R, 54 R

[56] References Cited

UNITED STATES PATENTS

| | | | |
|---|---|---|---|
| 2,195,008 | 3/1940 | Lessmann | 242/78.1 |
| 2,842,323 | 7/1958 | Rayburn | 242/128 |
| 3,025,009 | 3/1962 | Aschinger | 242/54 R |
| 3,202,380 | 8/1965 | Hosbein | 242/128 |
| 3,782,662 | 1/1974 | Miller | 242/78.1 X |
| 3,796,384 | 3/1974 | Rosen | 242/47.01 |
| 3,822,833 | 7/1974 | Fecker | 242/47.01 |
| 3,891,155 | 6/1975 | Naegeli | 242/47.12 X |

FOREIGN PATENTS OR APPLICATIONS

| | | | |
|---|---|---|---|
| 289,974 | 5/1928 | United Kingdom | 242/78 |

*Primary Examiner*—Stanley M. Gilreath
*Assistant Examiner*—John M. Jillions
*Attorney, Agent, or Firm*—Buell, Blenko & Ziesenheim

[57] ABSTRACT

Wire being continuously drawn from a processing apparatus or other supply to a rotatably-driven take-up reel while the reel is being replaced is temporarily stored on a wire accumulator which is positioned, preferably temporarily, between the supply and the reel and which comprises an accumulator drum supported on a frame with one end free and means for rotatably driving the drum about its axis at any speed within a limited range of speeds. The accumulator drum carries means for continuously imparting tension to wire as wire is unwound over the free end of the drum.

3 Claims, 3 Drawing Figures

WINDING WIRE AND OTHER FLEXIBLE MATERIAL

Figure 1:
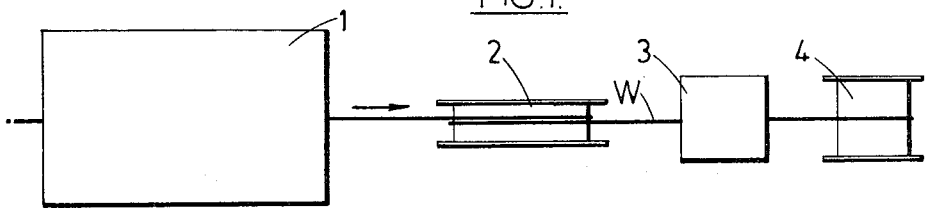

During the processing or handling of wire and other elongate flexible material (hereinafter referred to generically as "wire") in which wire being drawn from processing or other apparatus is wound around a rotatably-driven take-up reel, it is necessary at periodic intervals to replace a take-up reel that has become fully wound with wire by an empty take-up reel. In certain processes it is desirable that movement of the wire through the processing apparatus is not stopped whilst a take-up reel is being changed. An example of such a process is a wire enamelling process.

It is an object of the present invention to provide a simple and inexpensive method of temporarily storing wire being continuously drawn from a processing apparatus or other supply to a rotatably-driven take-up reel while the reel is being replaced.

According to the invention the method comprises positioning between the supply and the rotatably-driven take-up reel a wire accumulator comprising an accumulator drum supported on a frame with one end free and means for rotatably driving the drum about its axis at any speed within a limited range of speeds; passing a loop of wire travelling from the haul-off device to the take-up reel over the free end of the accumulator drum and on to the drum so that wire travelling from the haul-off device to the take-up reel is now drawn over the free end of the drum in such a way that tension is continuously imparted to the travelling wire; rotatably driving the accumulator drum at a gradually increasing speed until the accumulator drum is being rotatably driven at a peripheral speed substantially equal to the linear speed of the wire; stopping the take-up reel thereby to cause wire from the supply to be wound around the accumulator drum; cutting the length of wire extending between the wire accumulator and the take-up reel and replacing the take-up reel by another take-up reel (hereinafter referred to as the second take-up reel); securing the free end of the length of wire extending from the wire accumulator to the second take-up reel; rotatably driving the second take-up reel at a gradually increasing speed until the peripheral speed of the second take-up reel is substantially greater than the peripheral speed of the accumulator drum so that wire is unwound over the free end of the accumulator drum under a continuously imparted tension and is wound around the second take-up reel; effecting a gradual decrease in speed of the second take-up reel as the amount of wire on the accumulator drum is reduced until, when a single loop of wire remains wound on the accumulator drum, the peripheral speed of the second take-up reel is substantially equal to the linear speed of the wire; and removing the loop of wire from the drum.

Preferably the wire accumulator is temporarily positioned between the supply and take-up reel and is withdrawn after the loop of wire is removed from it.

Generally, but not necessarily, the wire will be drawn from the supply at a substantially constant speed.

The invention also includes wire processing or handling plant which comprises a wire processing apparatus or other supply from which wire can be continuously drawn; a rotatably-driven take-up reel around which wire being continuously drawn from said apparatus can be wound; and, positioned between the supply and the take-up reel, a wire accumulator comprising an accumulator drum supported on a frame with one end free, means carried by the drum for continuously imparting tension to wire as wire is unwound over the free end of the drum, and means for rotatably driving the drum about its axis at any peripheral speed within a limited range of peripheral speeds; the arrangement being such that wire travelling from the supply to the take-up reel can be temporarily stored by the wire accumulator whilst supply of wire to the take-up reel is stopped, the length of wire extending between the wire accumulator and the take-up reel is cut and the take-up reel replaced by another take-up reel, and that the free end of the length of wire extending from the wire accumulator can be secured to the second take-up reel, the second take-up reel rotatably driven and wire from the wire accumulator and subsequently from said supply wound around the second take-up reel with substantially no wastage of wire.

We prefer to employ as the wire accumulator in the method and plant of the present invention a wire accumulator in which the wire-tension imparting means comprises retarding means so secured to or integral with the free end of the drum that the wire being unwound from and drawn over the free end of the drum will be in contact with the retarding means. The arrangement is such that when a turn of wire passing from the processing apparatus or other supply to the take-up reel is looped around the accumulator drum, a length of wire can be wrapped around the accumulator drum by rotation of the drum without substantially impeding travel of the wire from the drum over the retarding means at the free end of the drum towards the take-up reel.

The retarding means preferably comprises a multiplicity of flexible elongate members which project, preferably radially, beyond the peripheral edge of the free end of the drum throughout the whole of the periphery, the flexible members being successively engaged by the travelling wire to impart the required tension to the wire as the wire is unwound from, and drawn over the free end of, the drum. The tension imparted to the travelling wire can be regulated by increasing or decreasing the number and/or density of the flexible elongate members and/or by increasing or decreasing the flexibility of the elongate members. With this end in view the multiplicity of flexible elongate members or other retarding means is preferably detachably secured to the free end of the drum. In a preferred embodiment the multiplicity of flexible elongate members is secured to the periphery of a disc that is detachably secured to the free end of the drum and the tension to be imparted to a wire can be predetermined by selecting a disc from a set of discs, each of which has flexible elongate members of a different material and/or different density from that of each of the other discs of the set. The material of which the flexible elongate members are made will be one which will not have any deleterious effect on the surface of the wire as it passes in contact with the members. The elongate members are preferably made of a tough plastics material, for instance nylon.

Preferably the frame of the wire accumulator supports an input guide for guiding the wire on to the drum.

An alternative form of wire accumulator for use in the method and plant of the present invention has rotatably mounted on the free end of the drum a flier which can be driven, in the same direction as the drum, by driving means capable of exerting a torque on the flier dependent on the required tension in the wire passing from the drum, and has mounted on the frame an input guide for guiding the wire on to the drum. In this wire accumulator the arrangement is such that when wire passing from the processing apparatus or other supply to a take-up reel is caused to pass through the input guide, the length of wire can be wrapped around the accumulator drum by rotation of the drum and flier without substantially impeding the movement of the wire towards the take-up reel.

Preferably the flier is driven by a frictional coupling between the drum and the flier.

In both of the wire accumulators described, preferably the accumulator drum is detachably supported on the frame. It is preferably mounted on and keyed to a rotatably-driven spindle supported on the frame with one end free.

The input guide is preferably mounted on traversing means to ensure that the wire is wound on the drum in spaced turns, the traversing means being driven by the same driving means as the drum. Preferably this driving means is a torque motor having a variable and controllable outlet speed.

Figure 2:
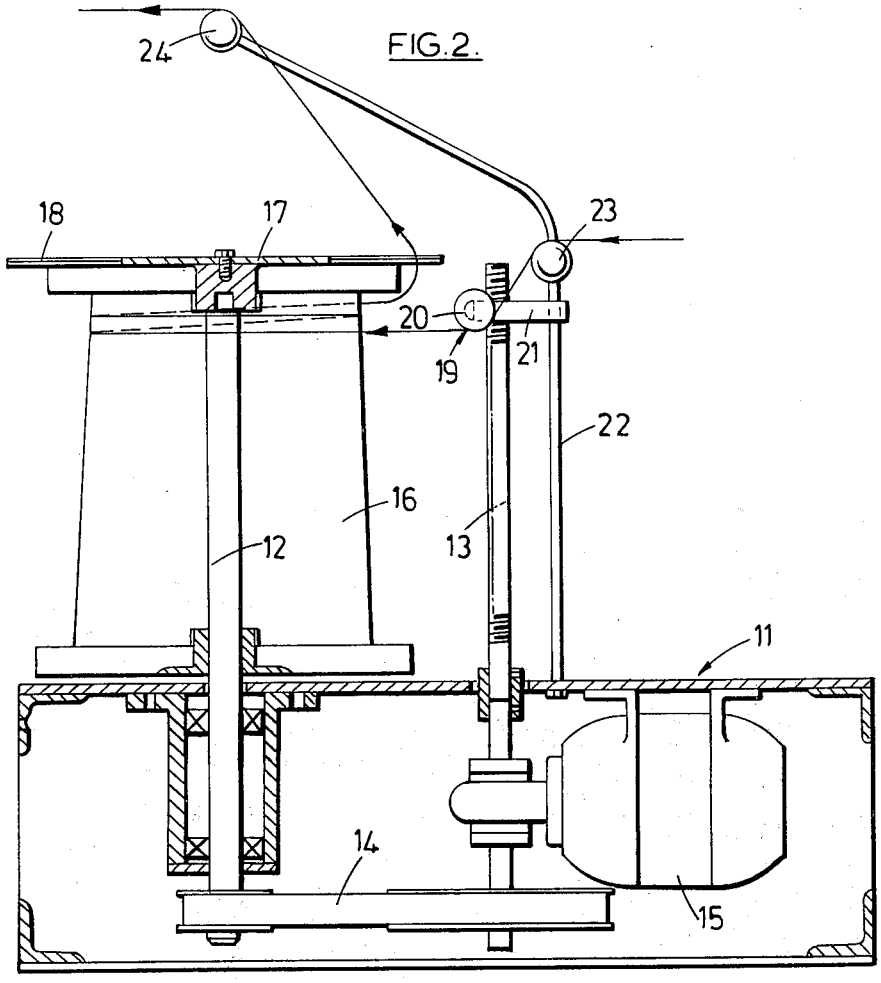
Figure 3:
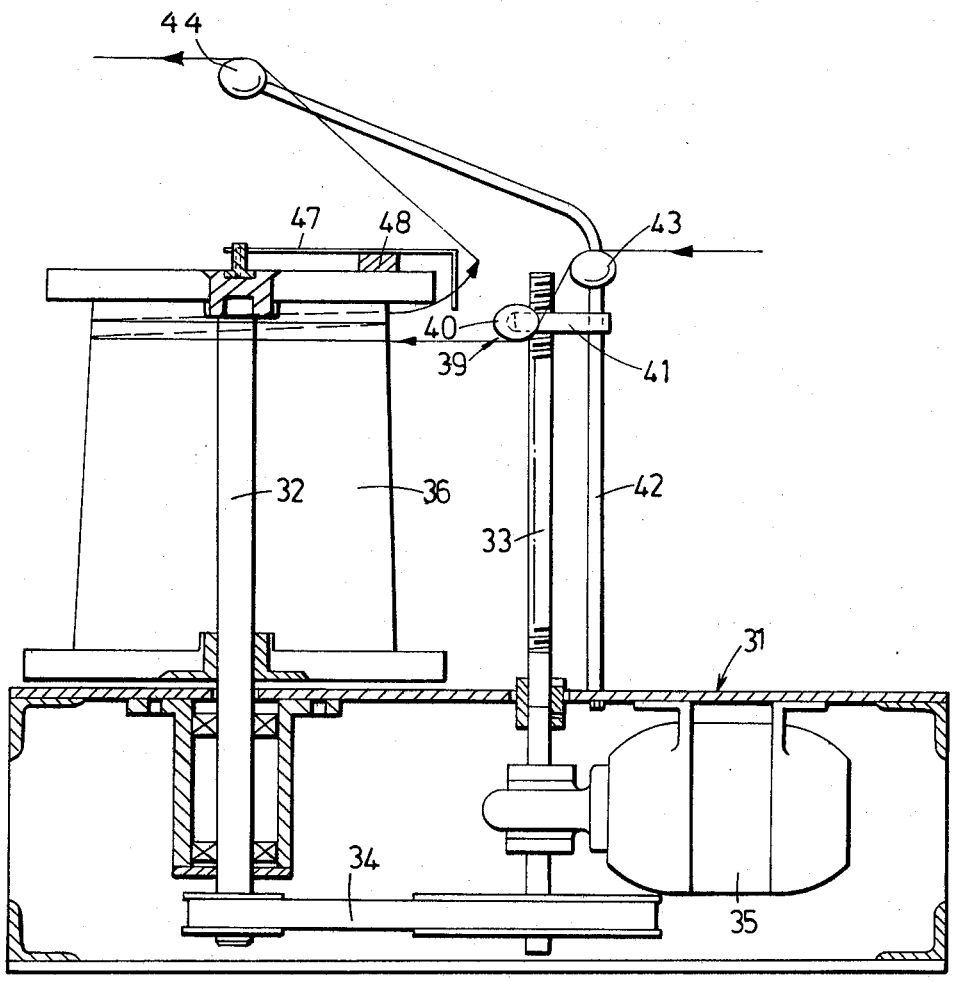

The invention will be further illustrated by description, by way of example, of the preferred method of temporarily storing wire being continuously drawn by a capstan from an enamelling apparatus whilst a rotatably-driven take-up reel is being replaced, of the preferred wire accumulator and of an alternative form of wire accumulator for use in the method, with reference to the accompanying drawings, in which:

FIG. 1 is a diagrammatic block diagram illustrating the plant used in the method; and FIGS. 2 and 3, respectively, are side views, partly in section and partly in elevation, of the preferred and alternative forms of wire accumulator.

Referring to FIG. 1, wire W is drawn at a substantially constant speed from a pay-out reel (not shown) by a capstan 2 through enamelling and drying apparatus 1 where a coating of enamel is applied and baked on the wire. From the capstan 2 the wire travels to a rotatably-driven take-up reel 4. When the take-up reel 4 is nearly fully wound with wire W a wire accumulator 3, which comprises an accumulator drum supported on a frame with one end free and a variable torque motor for rotatably driving the drum about its axis at any speed within a limited range of speeds, is positioned between the capstan 2 and take-up reel 4. A loop of wire W travelling from the capstan 2 to the take-up reel 4 is passed over the free end of the accumulator drum and on to the drum, the travelling wire now being drawn over the free end of the drum in such a way that tension is continuously imparted to the wire. The accumulator drum is rotatably driven at a gradually increasing speed until the accumulator drum is being rotatably driven at a peripheral speed substantially equal to the linear speed of the wire. The rotatably-driven take-up reel 4 is then stopped and the length of wire W extending between the wire accumulator 3 and the take-up reel is cut.

The take-up reel 4, now substantially fully wound with wire, is removed and replaced by an empty take-up reel and the free end of the length of wire extending from the wire accumulator 3 is secured to the empty take-up reel. The empty take-up reel is now rotatably driven at a gradually increasing peripheral speed until its speed is substantially greater than the peripheral speed of the accumulator drum so that wire W is unwound over the free end of the accumulator drum under a continuously imparted tension and is wound around the take-up reel. As the amount of wire W on the accumulator drum is reduced, a gradual decrease in peripheral speed of the take-up reel is effected until, when a single loop of wire remains wound on the accumulator drum, the peripheral speed of the take-up reel is substantially equal to the linear speed of the wire. The loop of wire W is then removed from the accumulator drum by passing the loop over the free end of the drum and the wire accumulator withdrawn from its position between the capstan 2 and take-up reel in readiness for use in another wire processing line.

During the exercise of replacing the fully wound take-up reel by an empty take-up reel the wire extending between the capstan and the fully wound take-up reel is cut once only and substantially no wire is scrapped.

The preferred form of wire accumulator shown in FIG. 2 suitable for use in the method and plant described with reference to FIG. 1 comprises a frame 11 on which are rotatably mounted an upstanding spindle 12 and, spaced from the spindle, an externally screw-threaded traverse spindle 13. The spindle 12 and the traverse spindle 13 are coupled by a belt-drive 14 and are driven by a variable torque motor 15. Mounted on and keyed to the spindle 12 is an accumulator drum 16 to the free end of which is detachably secured a disc 17 having extending radially from its periphery a multiplicity of bristles 18 of nylon, the disc being so secured as to rotate with the drum. An inlet guide 19 comprises a pulley 20 rotatably supported by a horizontal bar 21 which is threaded on to the traverse spindle 13 and is slidably mounted on a vertical guide pin 22 whose lower end is fixed to the frame 11. A part of the guide pin 22 remote from its lower end and extending beyond the free end of the accumulator drum 16 is bent towards the drum so that the free end of the guide pin, on which a pulley 24 is rotatably supported, lies close to the rotational axis of the drum. A second pulley 23 is rotatably supported on the guide pin 22 adjacent the free end of the traverse spindle 13.

As will be seen on referring to FIG. 2, when the wire accumulator is positioned between the capstan 2 and the take-up reel 4 wire travelling from the capstan to the reel is looped by hand over the free end of the drum 16 and on to the drum and is caused to pass over the pulley 23, under the pulley 20 and over the pulley 24, the wire continuing to travel freely from the capstan to the reel during the looping operation. In passing from the drum 16 to the pulley 24 the travelling wire passes around the free end of the drum and is in continuous contact with the bristles 18 of the disc 17 which impart the desired tension in the travelling wire.

The alternative form of wire accumulator shown in FIG. 3 is, in many, but not all, respects similar to that shown in FIG. 2 and components of the alternative form of wire accumulator that are similar to components of the accumulator shown in FIG. 2 have been given numerical references differing by 20 from the references for the similar components of the preferred wire accumulator. The alternative form of wire accumulator differs from the preferred wire accumulator by the fact that in place of the disc with radially extending nylon bristles there is provided a flier 47 which is rotatably mounted on an axially extending pin carried at the free end of the accumulator drum 36 and which, when the drum is being rotatably driven by the motor 35, is rotatably driven by the drum via a frictional coupling 48 in the same direction as the drum.

As will be seen on referring to FIG. 3, when the alternative form of wire accumulator is positioned between the capstan 2 and the take-up reel 4 wire travelling from the capstan to the reel is looped by hand over the free end of the drum 36 and on to the drum and is caused to pass under the pulley 43, over the pulley 40 and to engage the flier 47, the wire continuing to travel freely from the capstan to the reel during this looping operation.

The present invention has the important advantages that the take-up apparatus of any wire processing or handling line does not require a built-in device for temporarily storing wire being continuously drawn from the processing apparatus or other supply whilst a take-up reel is replaced, so that a single wire accumulator can be made available for use in any one of a number of wire processing or handling lines; and that during the exercise of replacing a take-up reel by another take-up reel the wire is cut only once and substantially no wire is scrapped.

What we claim as our invention is:

1. A method of temporarily storing wire being continuously drawn from a processing apparatus or other supply to a rotatably-driven take-up reel while the reel is being replaced, which method comprises positioning between the supply and the rotatably-driven take-up reel a wire accumulator comprising an accumulator drum supported on a frame with one end free and means for rotatably driving the drum about its axis at any speed within a limited range of speeds; passing a loop of wire travelling from the supply to the take-up reel over the free end of the accumulator drum and on to the drum causing the travelling wire to be drawn over the free end of the drum and, as the travelling wire passes over said free end, continuously imparting tension to the travelling wire; rotatably driving the accumulator drum at a gradually increasing speed until the accumulator drum is being driven at a peripheral speed substantially equal to the linear speed of the wire; stopping the take-up reel thereby to cause wire from the supply to be wound around the accumulator drum; cutting the length of wire extending between the wire accumulator and the take-up reel and replacing the take-up reel by another take-up reel; securing the free end of the length of wire extending from the wire accumulator to the second take-up reel; rotatably driving the second take-up reel at a gradually increasing speed until the peripheral speed of the second take-up reel is substantially greater than the peripheral speed of the accumulator drum so that wire is unwound over the free end of the accumulator drum under a continuously imparted tension and is wound around the second take-up reel; effecting a gradual decrease in speed of the second take-up reel as the amount of wire on the accumulator drum is reduced until, when a single loop of wire remains wound on the accumulator drum, the peripheral speed of the second take-up reel is substantially equal to the linear speed of the wire; and removing the loop of wire from the drum.

2. A method as claimed in claim 1, wherein, after the loop of wire is removed from the drum, the wire accumulator is withdrawn from between the supply and the rotatably-driven take-up reel.

3. A method as claimed in claim 1, wherein the linear speed of the wire travelling from the supply to the take-up reel is maintained substantially constant.

* * * * *